US007536735B1

(12) United States Patent
Stump

(10) Patent No.: US 7,536,735 B1
(45) Date of Patent: May 26, 2009

(54) SLEEP SYSTEM CONFIGURED TO ENSURE PROPER POSTURE WHILE SLEEPING

(76) Inventor: Sharon P. Stump, 605 Brandywine Dr., Goshen, IN (US) 46526

( * ) Notice: Subject to any disclaimer, the term of this patent is extended or adjusted under 35 U.S.C. 154(b) by 0 days.

(21) Appl. No.: 12/023,260

(22) Filed: Jan. 31, 2008

(51) Int. Cl.
*A47G 9/00* (2006.01)
*A61G 13/12* (2006.01)

(52) U.S. Cl. ..... 5/632; 5/636; 5/647; 5/650

(58) Field of Classification Search ..... 5/632, 5/636, 646, 647, 648, 650, 630; 128/845, 128/882, 878; 606/240
See application file for complete search history.

(56) References Cited

U.S. PATENT DOCUMENTS

| | | | | |
|---|---|---|---|---|
| 1,212,515 | A * | 1/1917 | Leavitt | 5/636 |
| 2,552,177 | A * | 5/1951 | Hurt | 2/24 |
| 2,795,802 | A * | 6/1957 | Myers | 5/632 |
| 3,148,389 | A | 9/1964 | Lustig | |
| 4,173,048 | A * | 11/1979 | Varaney | 5/632 |
| 4,392,489 | A | 7/1983 | Wagner, Sr. | |
| 4,706,302 | A | 11/1987 | Padfield et al. | |
| D366,801 | S | 2/1996 | Gray | |
| D393,073 | S | 3/1998 | Downing et al. | |
| 5,953,777 | A | 9/1999 | Buck | |
| 6,151,733 | A | 11/2000 | Takashima | |
| 6,154,905 | A | 12/2000 | Frydman | |
| 6,182,314 | B1 | 2/2001 | Frydman | |
| D438,624 | S | 3/2001 | Reina | |
| 6,701,555 | B1 | 3/2004 | Ermini | |
| 6,760,936 | B1 * | 7/2004 | Lloyd | 5/650 |
| D537,142 | S * | 2/2007 | Eagan | D21/803 |

* cited by examiner

*Primary Examiner*—Alexander Grosz
(74) *Attorney, Agent, or Firm*—Baker & Daniels LLP

(57) ABSTRACT

A system configured to ensure a sleeping person remains in a desired position. The system includes a head pillow and a leg pillow. The head pillow includes a locating area configured to receive a portion of the head of the sleeping person. In addition, the head pillow includes a receiving area configured to receive a portion of an arm of the sleeping person. The leg pillow includes a receiving area configured to receive a portion of the leg of a sleeping person. The leg pillow is generally located between the legs of the person and maintains the legs in a substantially parallel and spaced relationship.

3 Claims, 3 Drawing Sheets

SLEEP SYSTEM CONFIGURED TO ENSURE PROPER POSTURE WHILE SLEEPING

BACKGROUND

1. Field of the Invention

The present disclosure relates generally to a sleeping system designed to maintain a sleeping person in a desired position. In particular, the present disclosure relates to pillows configured to support the head and/or a leg of a sleeping person 2. Brief Description of Prior Art Leg pillows configured to assist a sleeping person to retain proper posture are generally known. For example, U.S. Pat. No. 4,392,489 discloses an Abduction Pillow. The abduction pillow includes a pair of oppositely facing elongated exterior surfaces positioned askew to each other. The pillow further includes a passageway configured to receive elongated flexible binding means. The binding means have a length larger than the size of the passageway thereby allowing for significant overlapping of the ends of the binding means about the leg of a patient. The binding means include pressure sensitive fastening means for holding the binding means about the leg of a patient. The binding means and pillow immobilize the leg of the wearer.

U.S. Pat. No. 4,703,302 discloses a Comfort Pad. The comfort pad includes a "Y"-shaped strap that wraps around the leg of a person. The strap is secured to a pillow that acts as a cushion.

U.S. Pat. No. 6,154,905 discloses an Orthopedic Support Pillow. The pillow has a low density polyurethane foam outer region and a high density polyurethane foam middle region. The outer region and middle region are joined as removably attached layers allowing the size of the device to be adjusted. The pillow includes leg clasps for engaging the inner thighs of an individual. A stem and a pair of crescent shaped buttresses define the leg clasps. The buttresses provide resistance to the wearer when the wearer tries to change positions. The relatively higher foam within the stem separates the users knees.

Similarly, head pillows configured to prevent a sleeping person from having poor posture are also known. For example, U.S. Pat. No. 4,173,048 discloses a Pillow Configuration including a central head supporting portion with two extension portions. The extension portions extend substantially perpendicular to the central portion. The resulting pillow provides built-in arm rests and prevents sheets from slipping. The pillow has a uniform cross-sectional area throughout its length.

SUMMARY OF THE INVENTION

An illustrative embodiment of the present invention includes a system configured for maintaining proper posture for a person sleeping. The system includes a first pillow and a second pillow. The first pillow includes a first receiving area. The first receiving area is configured to receive a head of a user. The second pillow includes a second receiving area. The second receiving area is configured to receive at least a portion of a leg of a user.

In embodiments of the invention, the first pillow includes a head portion and at least one arm portion. The head portion includes the first receiving area.

In embodiments of the invention, a valley defines the first receiving area of the first pillow. An elastic tube may define the second receiving area of the second pillow.

The first pillow may include a first sealable opening. The opening may allow the user to adjust the thickness of the pillow. The second pillow may include a second sealable opening. The second opening may allow a person using the pillow to adjust the thickness of the second pillow.

An embodiment of the invention includes a system configured to keep the spine of a sleeping person properly aligned. The system may include means for supporting the head of the sleeping person. The means may also ensure that the sleeping person remains on his side. In addition, the system may also include means for ensuring the legs of the sleeping person are spaced apart a desired distance.

An embodiment of the invention includes a pillow for keeping a person in proper alignment while sleeping. The pillow includes a head portion and at least one arm portion. The head portion includes a receiving portion configured to position the head of the person in a relatively fixed position.

In embodiments of the invention, an apparatus for keeping the legs of a sleeping person spaced apart a desirable distance includes a pillow and an elastic sleeve. The pillow includes an outer skin and a filler. The elastic sleeve is connected to the pillow and configured to receive at least a portion of the leg of the sleeping person.

Additional features of the invention will become apparent to those skilled in the art upon consideration of the following detailed description of the illustrated embodiments exemplifying the best mode of carrying out the invention as presently perceived.

BRIEF DESCRIPTION OF THE DRAWINGS

The above-mentioned and other features of this invention and the manner of obtaining them will become more apparent and the invention itself will be better understood by reference to the following description of an embodiment of the present invention taken in conjunction with the accompanying drawing, wherein.

Figure 1:
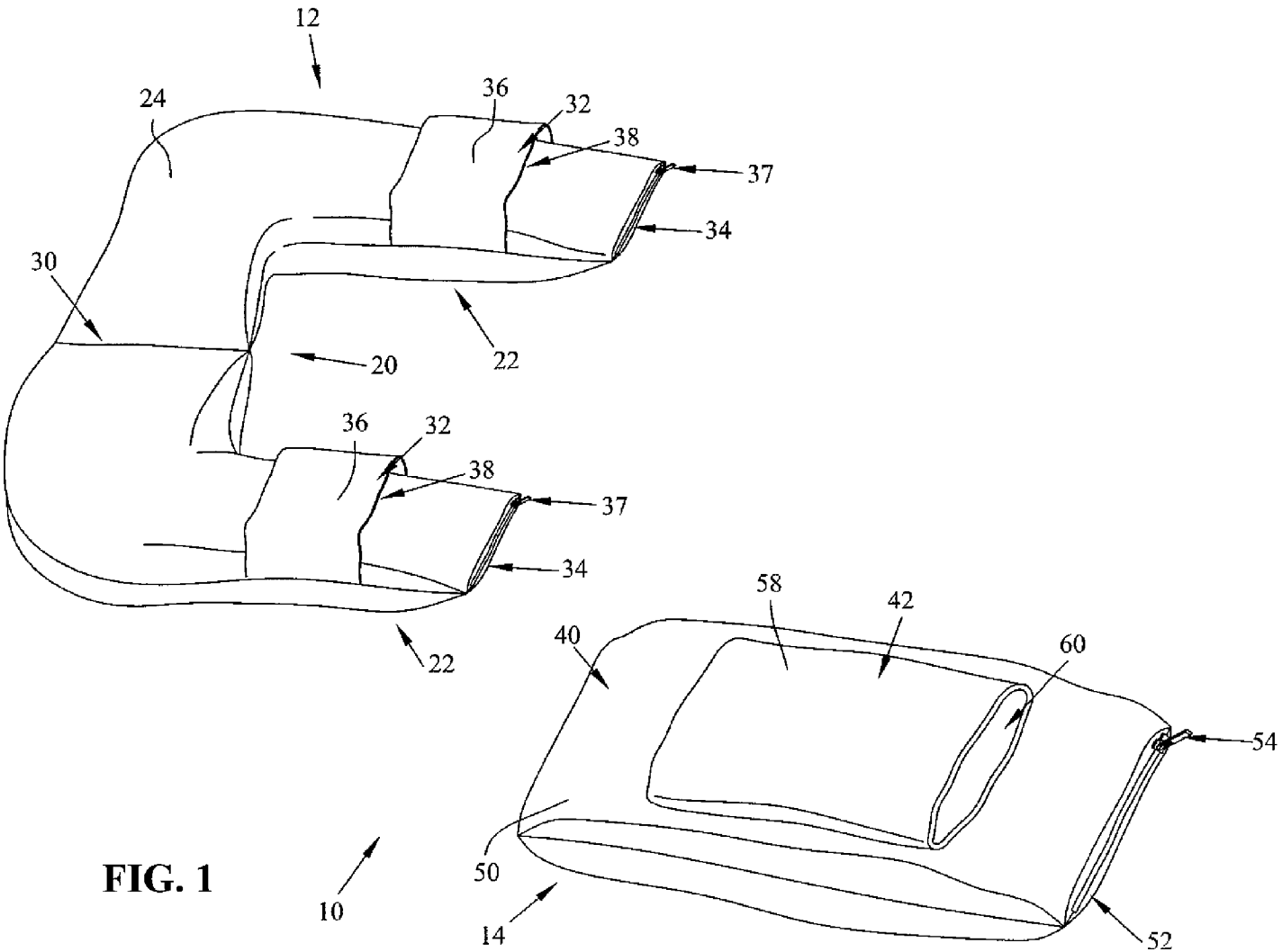
FIG. 1 depicts a perspective view of a system representing an embodiment of the present invention.

Although the drawing represents an embodiment of various features and components according to the present invention, the drawing is not necessarily to scale and certain features may be exaggerated in order to better illustrate and explain the present invention. The exemplification set out herein illustrates an embodiment of the invention, and such exemplification is not to be construed as limiting the scope of the invention in any manner.

DETAILED DESCRIPTION OF THE DRAWINGS

For the purposes of promoting an understanding of the principles of the invention, reference will now be made to the embodiment illustrated in the drawing, which is described below. It will nevertheless be understood that no limitation of the scope of the invention is thereby intended. The invention includes any alterations and further modifications in the illustrated device and described method and further applications of the principles of the invention, which would normally occur to one skilled in the art to which the invention relates. Moreover, the embodiment was selected for description to enable one of ordinary skill in the art to practice the invention.

FIG. 1 depicts a perspective view of a system, generally indicated by numeral 10, configured to ensure proper posture in a sleeping person. System 10 includes a head pillow 12 and a leg pillow 14. In the depicted embodiment, head pillow 12 includes a head portion, generally indicated by numeral 20, and two arm portions, each generally indicated by numeral 22. Head pillow 12 further includes an outer skin 24 that may be any suitable skin 24 known in the art, such as a cotton fiber material. The interior of the skin 24 is filled with filler material (not shown). The filler material may be any suitable material known in the art, such as a polyester fiber.

Head portion 20 includes a receiving area, generally indicated by numeral 30. In the depicted embodiment, a valley defines receiving area 30. The bottom of the valley 30 represents a fold which may be used to fold the head pillow 12 for storage or the like.

Referring still to FIG. 1, each of the arm portions 22 includes a receiving area 32 and a resealable aperture 34. Receiving areas 32 may be formed by a flap of material 36 attached to outer skin 24 in a suitable manner. Flap 36 may be formed of any suitable material, including the material forming outer skin 24. At least a portion of the flap 36 is spaced apart from skin 24 in order to define a space 38 therebetween.

In the depicted embodiment, resealable apertures 34 include a zipper 37. Zipper 37 be used to open and close the apertures 34 in a conventional manner. When the apertures 34 are open, filler material (not shown) may be added to or removed from the pillow 12 in order to increase or decrease the thickness of the pillow as desired. It should be noted that the zippers 37 may be replaced by any suitable mechanism capable of selectively sealing and unsealing the apertures 34.

Referring still to FIG. 1, second pillow 14 includes a pillow portion, indicated by numeral 40, and a receiving area, indicated by numeral 42. Pillow portion 40 includes an outer skin 50 defining an internal area filled by filler material (not shown). Outer skin 50 may be any suitable type of skin known in the art. Pillow portion 40 further includes a sealable aperture indicated by numeral 52. A zipper 54 is configured to open and close the aperture 52 as desired. When aperture 52 is unsealed, the filler material may be added to or removed from the interior of the skin 50 in order to increase or decrease the thickness of the pillow portion 40 as desired.

In the depicted embodiment, receiving area 42 comprises an elastic member 58. The elastic member 58 may be attached to the outer skin 50 in any suitable manner. Member 58 defines an interior generally indicated by numeral 60. As elastic member 58 is elastic, the size of interior 60 will generally adjust its size automatically to receive a leg or other appendage extending therethrough.

Figure 2:
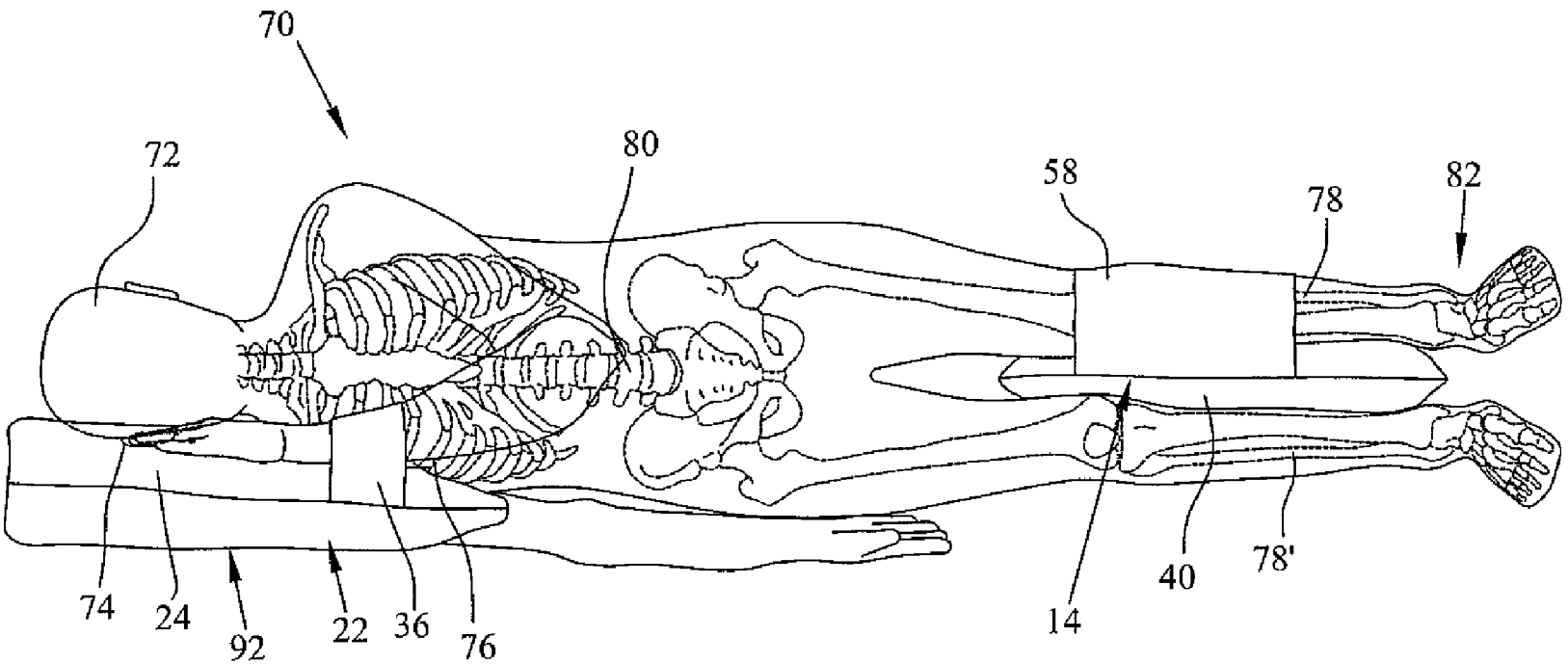
FIG. 2 depicts a view of the embodiment depicted in FIG. 1 in use.

Referring now to FIG. 2, a sleeping person 70 is shown utilizing the system 10 described in FIG. 1. When system 10 is properly used, at least a portion of head 72 of the person 70 resides within valley 30. Specifically, in the depicted embodiment, the ear 74 of the person 70 is located within the valley 30. In addition, a portion of the arm 76 of person 70 resides within receiving area 32 of one of the arm portions 22. Specifically, a portion of the arm 76 is within located intermediate flap 36 and outer skin 24.

One of the legs 78 of the person 70 resides within the receiving portion 42 of leg pillow 14. Specifically, the elastic 58 of the pillow 14 receives leg 78. Moreover, the pillow portion 40 of the leg pillow 14 should be rotated such that it is positioned intermediate the legs 78 and 78' of the person 70.

As shown in FIG. 1, the utilization of the system 10 retains the person 70 on his side. Specifically, the location of arm 76 within the receiving area 32 of the head pillow 12 prevents the person 70 from rolling over. Moreover, the utilization of the leg pillow 14 keeps the legs 78, 78' of the person 70 substantially parallel. This results in a substantially straight spine 80 for person 70.

Figures 3, 4:
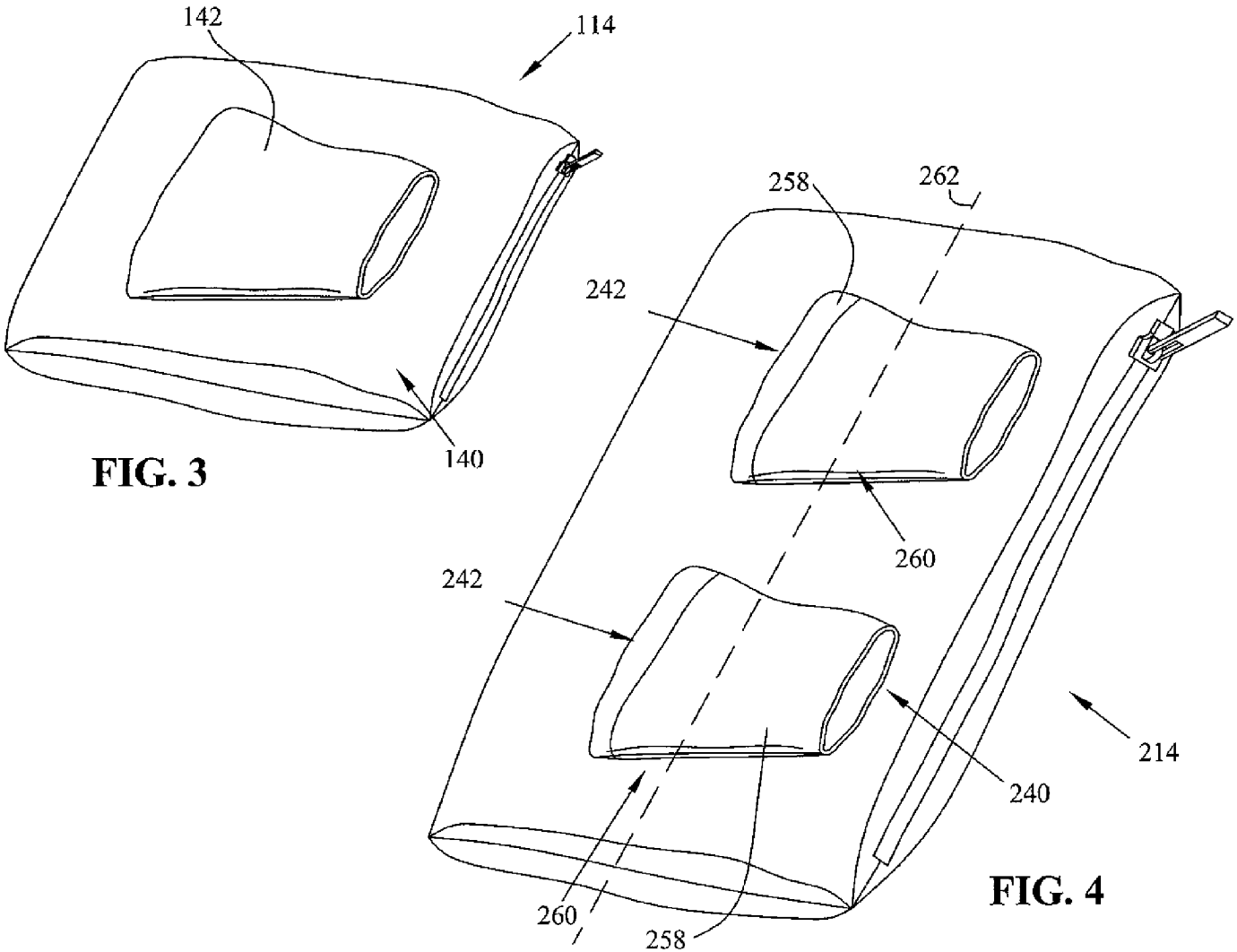
FIG. 3 depicts a perspective view of another embodiment of the leg pillow utilized in the system depicted in FIG. 1.
FIG. 4 depicts a perspective view of another embodiment of the leg pillow utilized in the system depicted in FIG. 1.

FIG. 3 depicts an alternative leg pillow generally indicated by numeral 114. Alternative leg pillow 114 includes a pillow portion 140 and a receiving member 142. In the depicted embodiment, pillow portion 140 has a substantially square shape. In addition, the receiving portion 142 also is generally smaller than that depicted in the leg pillow 14 depicted in FIG. 1. Accordingly, leg pillow 114 may receive an ankle 82 of a person 70. In this manner, leg pillow 114 may also ensure that the legs 78, 78' of the person 70 remain substantially parallel. In addition, leg pillow 114 may be utilized in additional applications, such as to support the ankles of a person in a wheelchair in order to prevent pressure sores.

FIG. 4 depicts a leg pillow 214 including a pillow portion 240 and a pair of receiving portions, each indicated by the numeral 242. In the depicted embodiment, the receiving portions 242 each include an elastic member 258 that defines an opening 260. The receiving portions 242 are generally arranged parallel with respect to the longitudinal axis 262 of the pillow 214. In the depicted embodiment, when in use, one of the receiving portions 242 receives an ankle 82 of the person 70 and the other receiving portion 242 receives the other ankle 82 of the person 70. Leg pillow 214 may be used to stabilize the ankles of a sleeping person. In addition, leg pillow 214 may be used to stabilize the legs of a person utilizing a wheelchair. Leg pillow 214 keeps the legs of the person substantially parallel and prevents the pressure sores on the legs of a person in a wheelchair.

Although the present invention has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

The invention claimed is:

1. A system for maintaining a sleeping person in a desired position, including:

a first pillow including a first receiving area configured to receive at least a portion of head of a user, the first pillow including a pair of arm portions located on opposite sides of the first receiving area, the first receiving area including a valley being defined by a fold permitting the folding of the pillow, and at least one of the arm portions including an elastic flap for receipt of an arm of a user and a resealable opening allowing the user to adjust the thickness of the pillow; and a second pillow including a second receiving area configured to receive at least a portion of a leg of a user, the second pillow including an elastic flap to receive the leg of the user, and a sealable opening allowing adjustment of thickness of the second pillow, whereby the first pillow and the second pillow are configured to maintain the user in a side position with at least a portion of the user's upper arm located in the elastic flap of the first pillow, and the second pillow is located between the legs of the user with at least a portion of the user's upper leg in the elastic flap of the second pillow.

2. The system as set forth in claim 1 wherein the first pillow includes a head portion, the head portion including the first receiving area.

3. A system configured to keep the spine of a sleeping person in a desired position comprising:

means for supporting the head of the sleeping person and ensuring the sleeping person remains on his side, including a first pillow with two arm portions and at least one elastic flap configured to receive at least a portion of the arm of the sleeping person and the means for supporting the head includes a valley being defined by a fold permitting the folding of the pillow and a means for adjusting the thickness of the means for supporting the head including a resealable opening; and means for ensuring the legs of the sleeping person are spaced apart a desired distance, including a second pillow and a means for attaching the pillow to a leg including an elastic tubular member, whereby the means for supporting the head of the sleeping person and ensuring the person remains on his side and means for ensuring the legs of the sleeping person are spaced apart a desired distance maintain the user in a side position with at least a portion of the user's upper arm located in the elastic flap of the first pillow, and the second pillow is located between the legs of the user with at least a portion of the user's upper leg in the elastic flap.

* * * * *